US005918511A

United States Patent [19]

Sabbaghian et al.

[11] Patent Number: 5,918,511

[45] Date of Patent: Jul. 6, 1999

[54] ADJUSTABLE SOCKET WRENCH

[75] Inventors: Mehdy Sabbaghian, Baton Rouge, La.; Bryan Hivnor, Beaumont, Tex.; Gerard Soignet; Brian Mayeaux, both of Houston, Tex.; Wyndham Payne, Nashville, Tenn.

[73] Assignee: Board of Supervisors of Louisiana State University and Agricultural and Mechanical College, Baton Rouge, La.

[21] Appl. No.: 08/919,995

[22] Filed: Aug. 28, 1997

[51] Int. Cl.[6] ..... B25B 13/12

[52] U.S. Cl. ..... 81/128; 81/129

[58] Field of Search ..... 87/128, 129

[56] References Cited

U.S. PATENT DOCUMENTS

| | | | |
|---|---|---|---|
| 122,638 | 1/1872 | Neames . | |
| 857,220 | 6/1907 | Zanto . | |
| 1,531,377 | 3/1925 | Clarke . | |
| 2,392,931 | 1/1946 | Lundeen . | |
| 2,582,444 | 1/1952 | Lucht | 81/128 |
| 2,884,826 | 5/1959 | Bruhn | 81/128 |
| 3,664,213 | 5/1972 | Anati . | |
| 3,724,299 | 4/1973 | Nelson | 81/128 |
| 4,366,733 | 1/1983 | Colvin | 81/128 |
| 4,546,678 | 10/1985 | Stuckey . | |
| 4,578,982 | 4/1986 | Schrock . | |
| 5,249,490 | 10/1993 | Kennel . | |
| 5,261,263 | 11/1993 | Whitesell . | |

FOREIGN PATENT DOCUMENTS

| | | | |
|---|---|---|---|
| 9034 | 9/1879 | Germany | 81/128 |

*Primary Examiner*—James G. Smith
*Attorney, Agent, or Firm*—Roy, Kiesel & Tucker

[57] ABSTRACT

The present invention provides an adjustable socket for a socket wrench. In a preferred embodiment, the adjustable socket comprises a base plate and a collar plate rotatably attached to the base plate. The collar plate has a central opening formed by a plurality of internal sidewalls and there are movably positioned inside the central opening a plurality of gripping members. Each of the gripping members has a contacting surface which cumulatively define a gripping region. Furthermore, each of the gripping members is connected to the base plate and has a first end adapted to engage one of the internal sidewalls such that relative rotation of the base plate and the collar plate adjusts the gripping region.

21 Claims, 5 Drawing Sheets

ADJUSTABLE SOCKET WRENCH

BACKGROUND OF THE INVENTION

1. Field of the Invention

The present invention relates generally to socket wrenches, and more particularly to a socket for these types of wrenches where the socket is capable of adjustably adapting to different sizes of polygonal bolt heads, nuts or similar fastening hardware.

2. Background of Invention

There presently exists a large variety of wrenches used to tighten and loosen fastening devices such as a conventional bolt having a polygonal (typically hexagonal) bolt head and threaded nut. One popular type of wrench is the conventional socket wrench which grips the bolt head or nut with a cylindrically shaped socket having an interior surface formed to mate with the particular size and polygonal shape of the bolt head or nut. These socket wrenches are especially useful since they are usually employed with a ratcheting mechanism that allows continuous turning of the bolt head or nut without repositioning the wrench as required by convention crescent or open faced wrenches.

However, a common drawback of socket type wrenches is the necessity of having a separate socket for each of the standard sized bolt heads or nuts commonly found in the environment in which the wrench is used. It is common experience that considerable time is wasted switching from one socket to another when tightening or loosening bolts of different sizes. Often the user of the socket wrench must attempt placing two or three sockets on a bolt before determining which socket is actually the correct size. Furthermore, to accommodate the size range of bolts typically encountered requires carrying a large number or a full "set" of variously sized sockets. Generally this set of sockets is must be carried in some sort of case and the set is ruined if a single socket is lost.

It would be a significant advance in the art to provide a single a wrench socket that would be able to accommodate a large range of bolt sizes and thereby eliminate the many disadvantages discussed above. It would also be advantageous if the wrench socket were easily adjusted to the required bolt size and if the wrench socket facilitated making this adjustment with only one hand rather than requiring both hands.

OBJECTS AND SUMMARY OF THE INVENTION

It is therefore an object of this invention to provide an adjustable wrench socket that can be adjusted to accommodate a wide range of conventional bolt sizes.

It is also an object of this invention to provide a wrench socket that facilitates making the adjustment without ocuppying both hands of the user.

It is a further object of this invention to provide an adjustable wrench socket that will grip polygonal bolt head or nut on multiple sides of the polygon.

These and other objects and advantages of the present invention will no doubt become apparent to those skilled in the art after having read the following description of the preferred embodiment which are contained in and illustrated by the various drawing figures.

Therefore, the present invention provides an adjustable socket for a socket wrench. In a preferred embodiment, the adjustable socket comprises a base plate and a collar plate rotatably attached to the base plate. The collar plate has a central opening formed by a plurality of internal sidewalls and there are movably positioned inside the central opening a plurality of gripping members. Each of the gripping members has a contacting surface which cumulatively define a gripping region. Furthermore, each of the gripping members is connected to the base plate and has a first end adapted to engage one of the internal sidewalls such that relative rotation of the base plate and the collar plate constricts the gripping region.

DETAILED DESCRIPTION OF THE PREFERRED EMBODIMENTS

Figure 1:
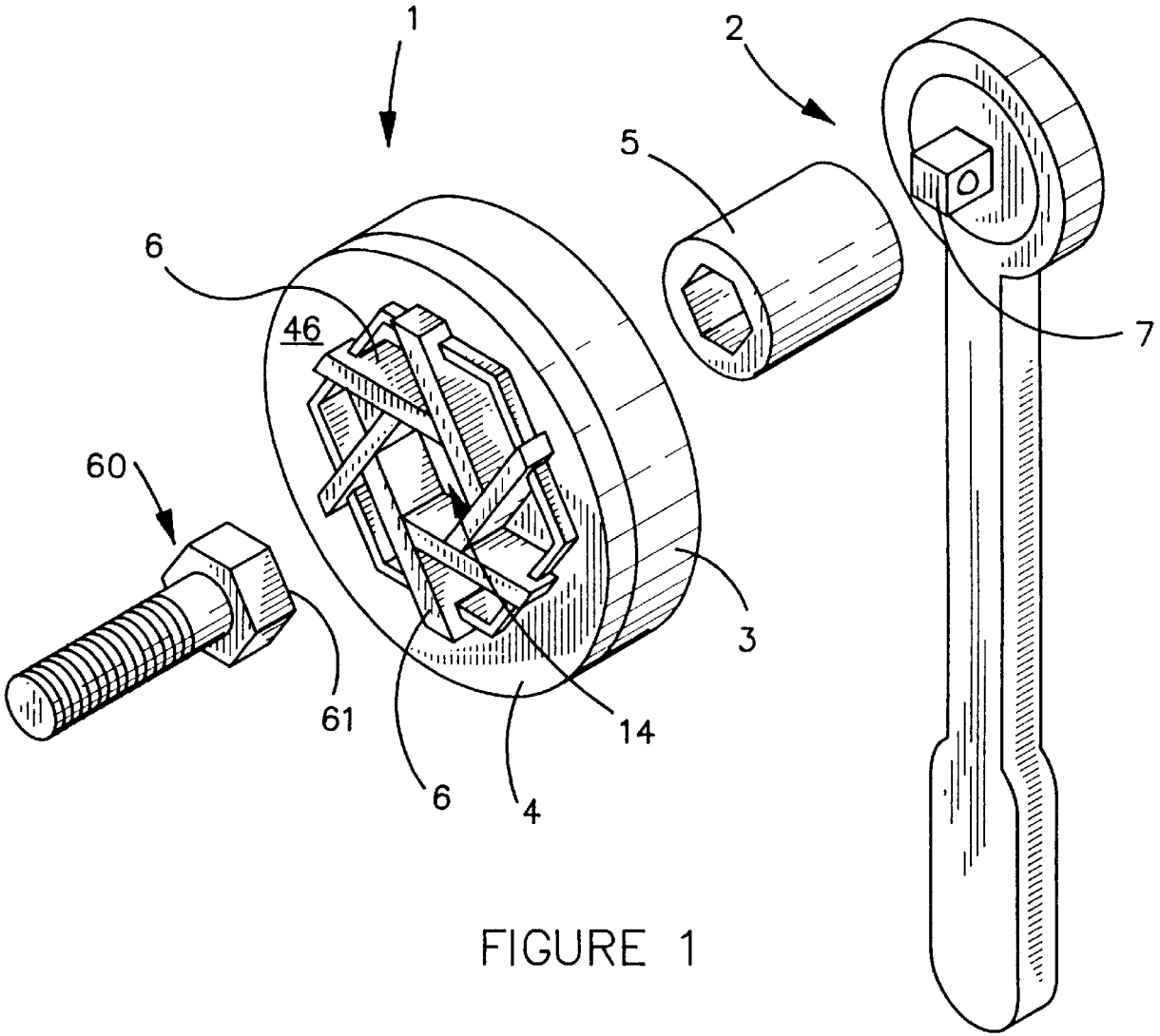
FIG. 1 is a is a perspective view of the present invention illustrating its use with a conventional socket wrench and bolt.

In the drawings, many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. The spreading use of electron beam welding eliminates many such features and leaves no visible distinctive lines. These types of details which are well known in the art may be necessary to the overall function of the invention, but are matters of designer's choice, are not claimed and, hence, not shown.

Figure 2:
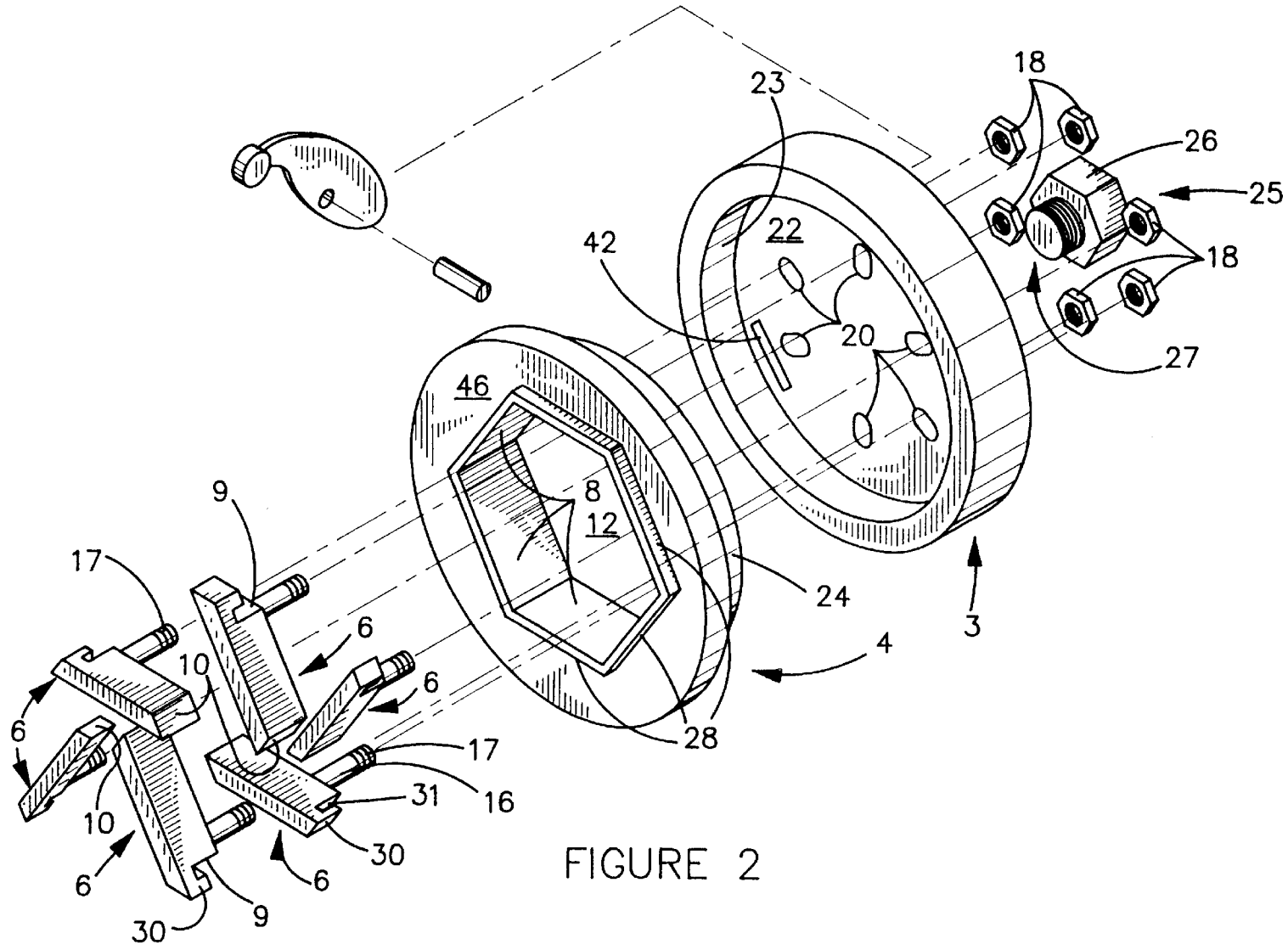
FIG. 2 is an exploded perspective view of the present invention showing its various components.
Figure 5:
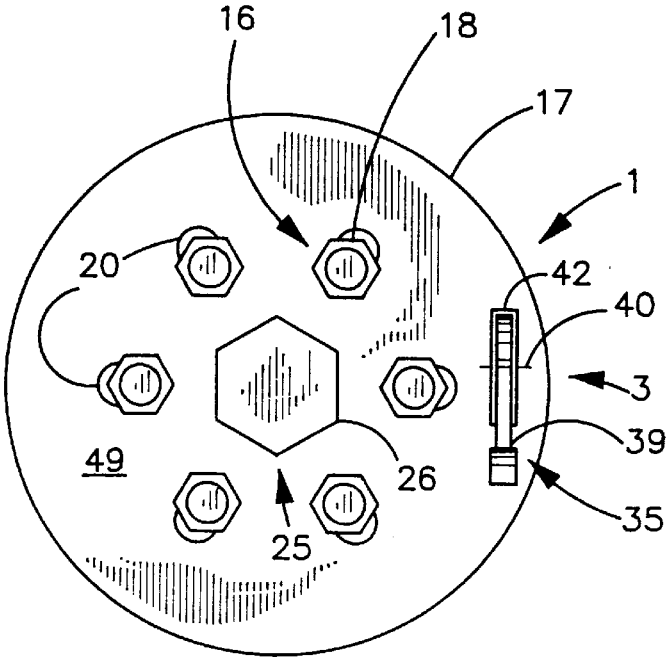
FIG. 5 is a plane view from the top orientation of the present invention.
Figure 4:
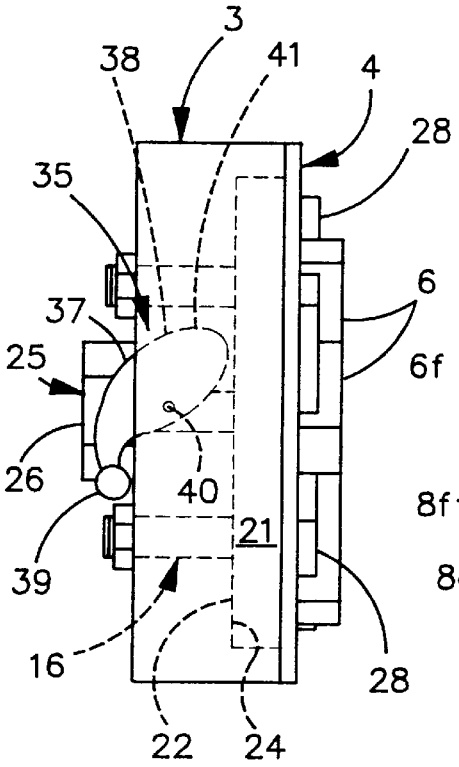
FIG. 4 is a side view of the present invention.

FIG. 1 illustrates one embodiment of the present invention, adjustable socket 1. Adjustable socket 1 is shown detached from a conventional socket 5 of socket wrench 2. Conventional socket 5 engages a socket spur 7 as is well known in the art. As best seen in FIGS. 2, 4 and 5 and as also explained in greater detail below, a bolt head 26 is fixed on adjustable socket 1 such that torque may be transferred from conventional socket 5 to adjustable socket 1. While explained in greater detail herein, it generally can be seen in FIG. 1 how adjustable socket 1 operates by matingly engaging hexagonal head 61 of conventional bolt 60 within the gripping region 14. While the adjustable socket 1 is shown engaging a conventional bolt head, adjustable socket 1 is also designed to engage the bolt nut that connects to the threaded end of a conventional bolt. Where adjustable socket 1 is described herein as engaging a bolt head, it will be understood that the same description applies to bolt nuts or any other type of polygonal fastening device.

The various components comprising adjustable socket 1 are better seen in FIGS. 2–6. FIG. 2 illustrates how this embodiment of adjustable socket 1 is formed by a base plate 3 and a collar plate 4. Collar plate 4 has a central opening 12 formed by a plurality of internal sidewalls 8. The embodiment shown in the figures comprises six internal sidewalls 8 which form a hexagonal central opening 12. The sidewalls 8 will extend above the exterior surface 46 of collar plate 4 in order to form guide ridges 28. The interior surface (hidden from view in FIG. 2) of collar plate 4 will also have a collar shoulder 24, which matingly engages a perimeter wall 23 defining a recess 22 within base plate 3. While the embodiment illustrated in the figures provides six sidewalls 8, the scope of the invention includes any number of sidewalls 8 which will allow adjustable socket 1 to function as intended. For example, alternate embodiments of the invention might comprise three or four sidewalls 8. The four sidewall 8 embodiment may be particularly suited for four-sided bolt heads.

Figure 6:
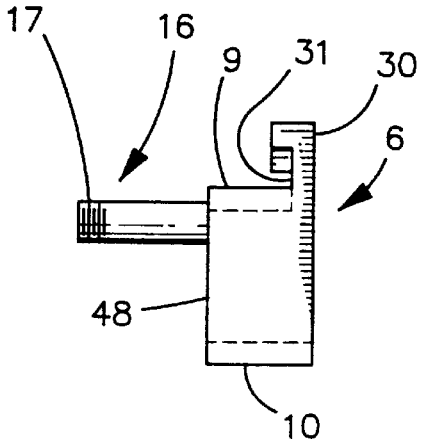
FIG. 6 is a side view of a gripping member employed by the present invention.
Figure 3:
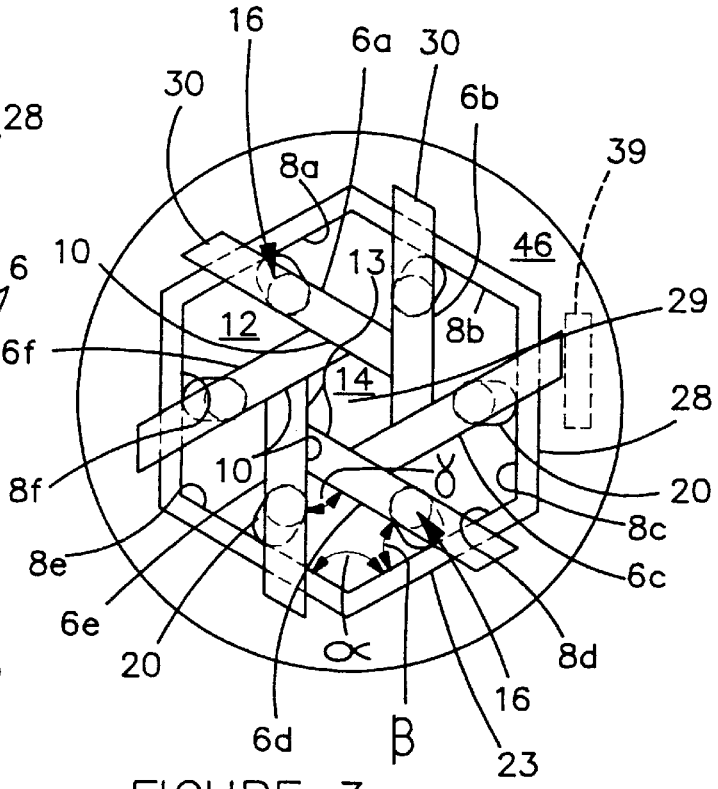
FIG. 3 is a plane view from the bottom orientation of the present invention.

Positioned within central opening 12 are a plurality of gripping members 6, which are identified individually in FIG. 3 as gripping members 6*a*–6*f*. While the illustrated embodiment provides six gripping members 6, the invention includes within its scope adjustable sockets having a different number of gripping members 6. Again such alternatives may include three or four gripping members 6 or any other number of gripping members 6 that allow the invention to function as intended. However, when dealing with a hexagonal bolt head, six gripping members 6 are preferred in order that torque will be equally distributed to all sides of the bolt head. The structural details of the individual gripping members 6 are best seen in FIGS. 2 and 6. Gripping members 6 have a first end 9 which is adapted to engage one of the internal sidewalls 8 of collar plate 4. This adaptation consists of shaping end 9 (best seen in FIG. 2) at an angle that will maintain gripping members 6 parallel to an adjacent sidewall 8 and the sidewall 8 opposite the adjacent sidewall 8 such as seen in FIG. 3. For example, gripping member 6*a* is oriented parallel to sidewalls 8*b* and 8*e*. Since the corner angles $\alpha$ of the equilateral hexagon are 120°, gripping members 6 will be oriented at an angle of $\beta$, which is 60° in the illustrated embodiment, in order to maintain them in parallel alignment with two sidewalls 8. As explained below, this will maintain the gripping members 6 in the desired polygonal configuration as they open and close. As seen in FIGS. 2 and 6, gripping members 6 will further have a finger 30 extending beyond end 9 with a channel 31 formed therein. Channel 31 will be formed at the same angle as end 9 and thus will run parallel to end 9 as illustrated by FIG. 3. When gripping members 6 are positioned in central opening 12, fingers 30, by way of channel 31, will slidably engage guide ridge 28 and assist in maintaining gripping members 6 in the correct orientation while they move within central opening 12 as described below. To aid in understanding the movement of gripping members 6 in central opening 12, reference is made to a hypothetical center point in central opening 12, center point 29.

Viewing FIG. 3, each gripping member 6 will further have a contacting surface 13 which provides the surface of gripping members 6 actually engaging the bold head. The area of central opening 12 which is surrounded by the contact surfaces 13 will form a gripping region 14, which as discussed below, will be adjustable in order to fit various sizes of bolt heads.

Returning to FIG. 2, it can be seen that gripping members 6 have a second end 10 which is adapted to slidingly engage adjacent gripping members 6 as suggested in FIG. 3. Similar to the first end 9, this adaptation is carried out by forming an angle on second end 10 such that gripping members 6 will from an angle $\gamma$ when engaging adjacent gripping members 6. Like angle $\beta$, angle $\gamma$ is 60° in the illustrated embodiment. The angles formed on first end 9 and second end 10 will maintain gripping members 6 in the orientation previously mentioned where gripping members 6 remain parallel to an adjacent sidewall 8 and the sidewall 8 opposite the adjacent sidewall 8, as the gripping members move toward and away from the center point 29. As seen in FIG. 6, each gripping member 6 will also have a connecting shaft 16 fixed to a bottom side 48 of gripping member 6. In the embodiment show, connecting shaft 16 has a threaded end 17. Viewing FIG. 2, it can be seen how gripping members 6 are secured within collar plate 4 and how base plate 3 and collar plate 4 are secured together by fingers 30 engaging guide ridge 28. A series of apertures 20 are formed through the thickness of base plate 3. Connecting shafts 16 will pass through apertures 20 such that threaded ends 17 may receive a nut 18 in order to hold gripping members 6 within central opening 12. With fingers 30 engaging guide ridge 28 and connecting shaft 16 being secured to base plate 3, collar plate 4 may rotate relative to base plate 3, but is otherwise securely attached thereto. In the embodiment shown, apertures 20 are formed in a somewhat elliptical shape. This elliptically shape aperture 20 allows for some lateral movement of connecting shafts 16 during operation of adjustable socket 1, the significance of which will be explained below. As seen in FIGS. 2, 4 and 5, base plate 3 will also have a wrench connector 25 fixed to the exterior surface 49 (seen in FIG. 5) of base plate 3. As best seen in FIG. 2, wrench connector 25 comprises a convention bolt 27 with polygonal bolt head 26. While the embodiment shown in the figures illustrates a conventional bolt 27 threadedly engaging base plate 3, any conventional means of fixing a wrench connector 25 to base plate 3 is intended to come within the scope of this invention. Nor is it necessary that wrench connector 25 be limited to external bolts heads. Rather connector 25 could also be an internal polygonal aperture for receiving the socket spur 7 of wrench 2 (seen in FIG. 1).

Figure 8:
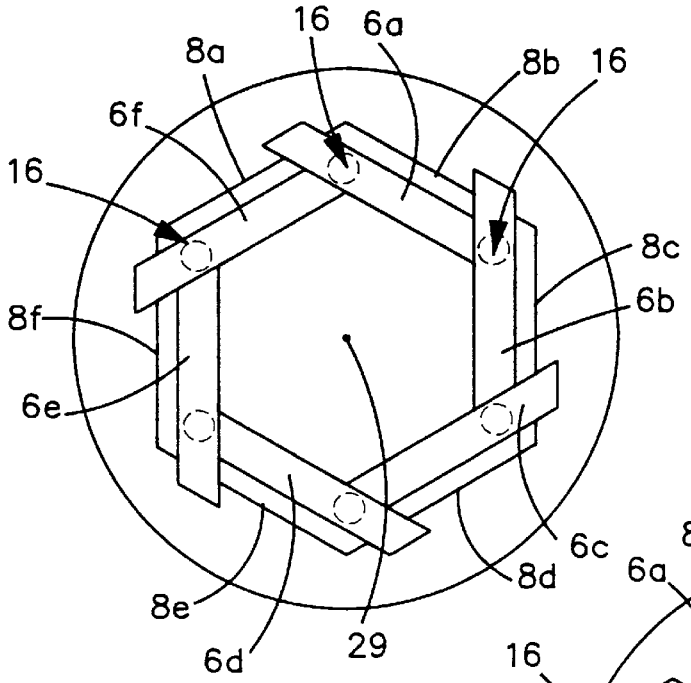
FIG. 8 is a plane view from the bottom orientation illustating the invention in the fully open position.

In operation, gripping members 6 will close (i.e. move toward center point 29) or open (i.e. move toward sidewalls 8) by the relative rotation between base plate 3 and collar plate 4. Viewing FIG. 3, it will be seen that movement of base plate 3 in a clockwise direction while collar plate 4 is held stationary will cause gripping members 6 to open or to move toward their respective adjacent sidewalls 8. For example, gripping member 6*a* will move toward sidewall 8*b*, gripping member 6*b* will move toward sidewall 8*c*, and so on with all the gripping members 6. When adjustable socket 1 is in its fully open position as seen in FIG. 8, gripping members 6 will rest against their respective parallel sidewalls 8. The point at which connecting shafts 16 meet gripping members 6 will rest in the intercies of the angle formed by (1) the sidewall 8 on which the gripping member 6 travels and (2) the parallel sidewall 8 against which the gripping member 6 rests. For example, connecting shaft 16 on gripping member 6*a* will rest in the intercies of sidewalls 8*a* and 8*b* as seen in FIG. 8.

Figure 9:
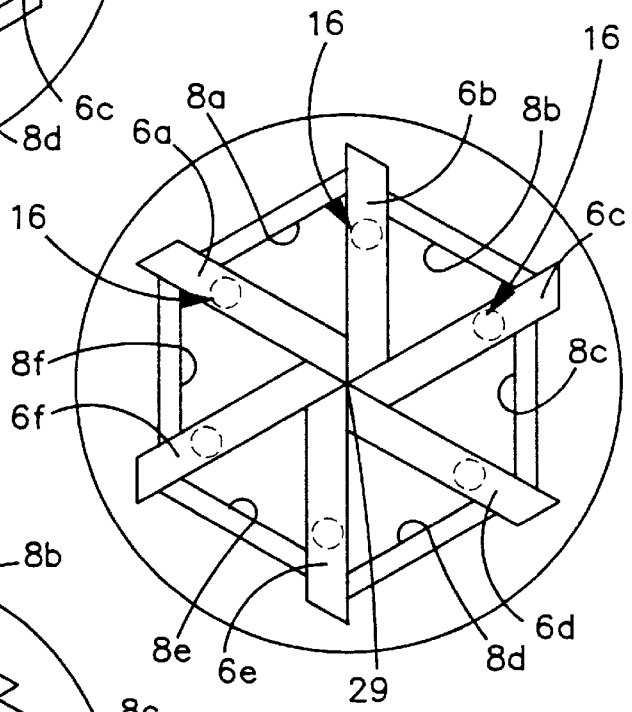
FIG. 9 is a plane view from the bottom orientation illustrating the present invention in the fully closed position.

Conversely, when it is desired to close the gripping members 6, movement of base plate 3 in a counterclockwise direction while holding collar plate 4 stationary will cause gripping members 6 to move toward the center point 29. Because of the angles formed on the ends 9 and 10 of gripping members 6, gripping members 6 remain parallel to an their adjacent parallel sidewalls 8 the entire time they are closing. If there is no bolt head for gripping members 6 to engage, they will reach a completely closed position and the ends 10 of gripping members 6 will meet at center point 29 as seen in FIG. 9. In this completely closed position, the connecting shafts 16 will then rest in the intercies of the angle formed by the sidewall 8 on which the gripping member 6 travels and the non-parallel adjacent sidewall 8. For example, in the completely closed position as shown in FIG. 9, the connecting shaft 16 of gripping member 6*a* would rest at the intercies of sidewalls 8*a* and 8*f*. Of course, the directions of relative rotation just described are based on the direction adjustable socket 1 is shown facing in FIG. 3. Those skilled in the art will understand that relative to the direction adjustable socket 1 is facing in FIG. 5, the directions of rotation would be the opposite. It will also be understood that the directions of rotation would be opposite if base plate 3 were held stationary and collar plate 4 rotated rather than the reverse situation described above.

Furthermore it can now be seen why apertures 20 are elliptical in shape. As gripping member 6 travels along sidewall 8, connecting shaft 16 has a slight radial movement toward and away from the center point 29. When connecting shaft 16 is in an intercies between two sidewalls 8, connecting shaft 16 is at its furthest distance from the center point 29. As gripping members 6 travel toward the midpoint of sidewalls 8, they and connecting shafts 16 move radially toward the center point 29. After passing the midpoint of sidewalls 8, gripping members 6 once again radially move away from the center point 29 as they approach the opposite intercies between sidewalls 8. The elliptical shape of aperture 20 is intended to accommodate this radial movement.

It will be understood that when gripping members 6 of adjustable socket 1 are closed on a bolt head, collar plate 4 and base plate 3 can no longer rotate relative to one another. This is because the bold head prevents gripping members 6 from moving closer to center point 29 and sliding any further along sidewalls 8. When base plate 3 is further rotated, gripping members 6, being wedged against sidewalls 8, will force a simultaneous rotation of collar plate 4. Therefore torque applied to wrench connector 25 will cause gripping members 6 to apply more closing force on the bolt head while the torque is simultaneously transferred to the bolt head. In the embodiment shown, the direction of torque which closes gripping members 6 is the direction of torque that would tighten a bolt head (i.e., cause a bolt head to engage a threaded surface). For ease of explanation, the direction of torque tightening a bolt head will be referred to as "positive" torque. However, the direction of torque required to loosen a bolt head (i.e disengage a threaded surface), or "negative" torque, would only cause gripping members 6 to open and therefore gripping members 6 could not simultaneously grip a bolt head and apply negative torque. Therefore adjustable socket 1 must be modified to hold gripping members 6 closed on the bolt head while negative torque is applied.

One such modification is seen in FIGS. 4 and 5 and comprises a stop member 35 included on the adjustable socket 1. In the embodiment shown, stop member 35 is a cam member 37 having a cam lobe 38, a cam release arm 39, and a cam pin 40. A cam slot 42 will be formed in base plate 3 as seen in FIG. 5. Cam slot 42 communicates through base plate 3 as seen in FIG. 2 and is sized to allow cam lobe 38 of cam member 37 to contact the shoulder 24 of collar plate 4 as seen in FIG. 4. Cam member 35 will be pivotally pined to base plate 3 by cam pin 40 and a cam release arm 39 will extend from cam member 35 opposite cam lobe 38. Cam pin 40 is positioned between cam lobe 38 and cam release arm 39 such that manually raising release arm 39 will cause cam lobe 38 to lower and engage shoulder 24 of collar plate 4. Conversely, depressing cam release arm 39 will raise cam lobe 38 out of contact with collar plate 4. Cam lobe 38 will have a cam surface 41 which is adapted to prevent relative rotation between base plate 3 and collar plate 4 in a particular direction when release arm 39 is raised and cam lobe 38 engages shoulder 24. In the embodiment shown, cam surface 41 prevents relative rotation which would tend to open gripping members 6 when negative torque is applied. When relative rotation of collar plate 4 is urged in the negative torque direction, cam member 37 tends to rotate forward, pressing base plate 3 and collar plate 4 apart. This separating force acts to couple collar plate 4 and base plate 3 together, preventing relative rotation. The curvature of cam surface 41 is such that any relative rotation in the negative torque direction tends to draw cam surface 41 further into collar plate 4 and create even greater resistance to relative rotation. In this manner, adjustable socket 1 may be placed on a bolt head to be loosened and the gripping arms closed to the size of the bolt head. Then torque is applied in the negative torque direction causing cam member 37 to engage collar plate 4 and prevent relative rotation that would tend to open gripping members 6. After the bolt head has been loosened the desired amount, the torque application is ceased and cam release arm 39 is depressed, raising cam surface 41 out of contact with collar plate 4.

Figure 10:
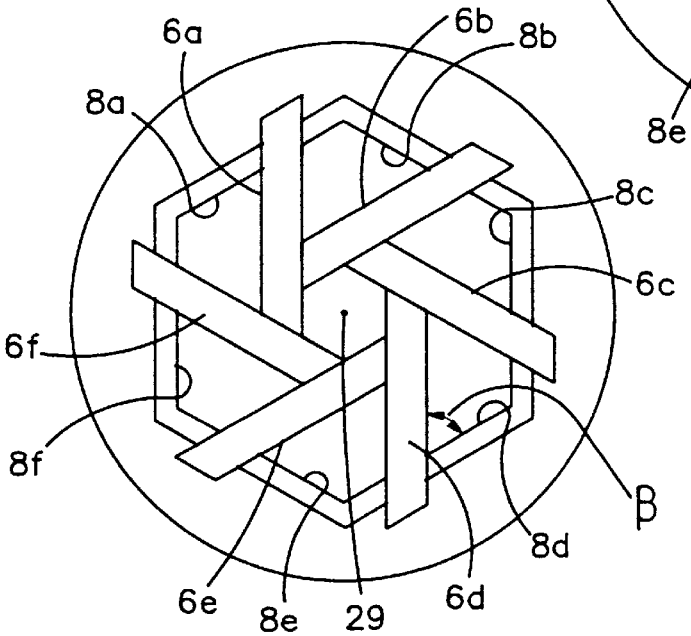
FIG. 10 is a plane view from the bottom orientation illustrating the gripping members in a reverse orientation from that seen in FIG. 3.

An alternative embodiment of adjustable socket 1 could be formed by reversing the direction of relative rotation which causes gripping members 6 to open and close. In other words, negative torque would close gripping members 6 while positive torque would open them. Viewing FIG. 3, it can be seen that gripping members 6 are rotated to the left in order to form the angle β between each gripping member 6 and the sidewall 8 upon which it travels. As explained above, this causes gripping members 6 to close when a positive torque is applied. However, if the positioning of gripping members 6 was reversed as seen in FIG. 10 such that all gripping members 6 were rotated to their right in order to form the angle β between the gripping members 6 and sidewalls 8, then the direction of relative rotation that causes closing would also be reversed. In this configuration, a negative direction of torque would cause gripping members 6 to close. Therefore a bolt head could be loosened without the need for the any type of stop device 35. Of course, this embodiment could not tighten the bolt head without a stop device 35. In this embodiment, it is envisioned that as an alternative to a stop device 35, the user would carry two adjustable sockets 1. The first adjustable socket 1 would close gripping members 6 when torque was applied in the positive direction and would be used for tightening bolt heads. The second adjustable socket 1 would close gripping members 6 when torque was applied in the negative direction and would be used for loosening bolt heads. In this manner it would be unnecessary to manufacture adjustable sockets 1 with stop devices 35.

Figure 7:
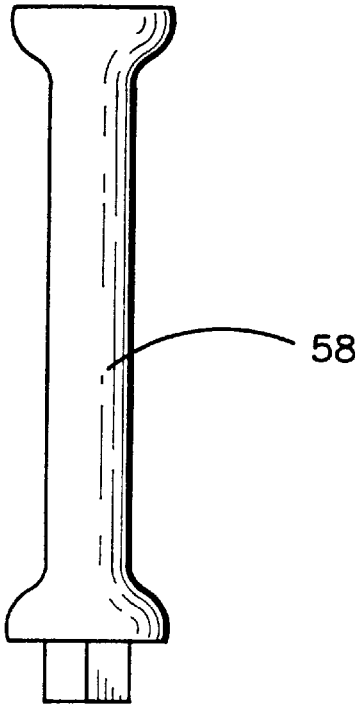
FIG. 7 is a side view of a double socket configuration.
Figure 7:
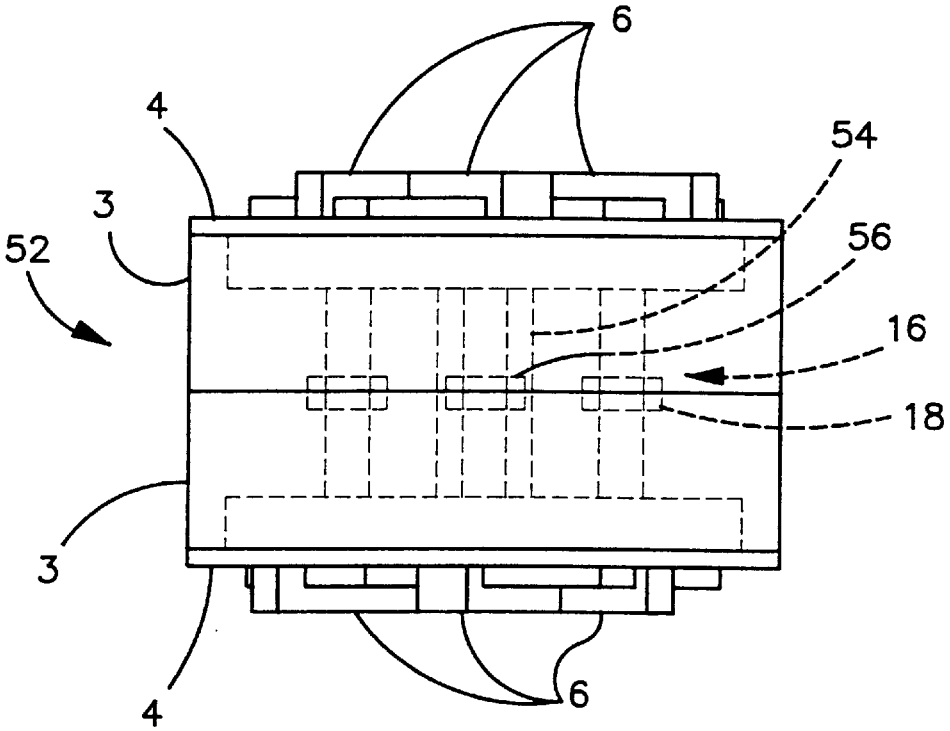

Another embodiment combines the two adjustable sockets 1 described immediately above. This embodiment, seen in FIG. 7, adapts two adjustable sockets 1 having opposite directions of rotation such that they may be fixed in a back to back configuration with base plates 3 being connected together. Double socket configuration 52 differs from previous embodiments in that it counter-sinks the nuts 18 that will secure gripping members 6 to their respective base plates 3. Furthermore, double socket configuration 52 does not utilize an external wrench connector 25 as seen in the embodiment of FIGS. 1–5. Rather a center aperture 54 communicates completely through the thickness of both base plates 3. At the center of the combined base plates 3 is formed an internal wrench connector 56 which will be accessible form either side. In the embodiment shown, internal wrench connector 56 comprises a polygonal aperture adapted to receive a convention socket spur 7 as seen in FIG. 1. However, it is envisioned that a conventional extended socket spur 58 will be used to engage internal wrench connector 56. When using double socket configuration 52, one side of the combined tool is placed on the bolt head depending on whether the bolt head is to be tightened or loosened. Extended socket spur 58 is then inserted through center aperture 54 from the other side until it engages internal wrench connector 56. Thereafter, double socket configuration 52 is used as described for the other embodiments.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. An adjustable socket for a socket wrench, said adjustable socket comprising:

a. a base plate;

b. a collar plate rotatably attached to said base plate and having a central opening formed by a plurality of internal sidewalls;

c. a plurality of gripping members movably positioned in said central opening, i. each of said gripping members having a contacting surface which cumulatively define a gripping region, and ii. each of said gripping members being connected to said base plate and having a first end adapted to engage one of said internal sidewalls and a second end adapted to engage another one of said plurality of gripping members such that relative rotation of said base plate and said collar plate causes said first ends to slide along said internal sidewalls and said second ends to slide along another gripping member thereby adjusting an area within said gripping region.

2. An adjustable wrench socket according to claim 1, wherein each of said gripping members are rotatively connected to said base plate by way of a shaft connected to said gripping member and extending through an aperture in said base plate.

3. An adjustable wrench socket according to claim 2, wherein said apertures are elliptical in shape.

4. An adjustable wrench socket according to claim 1, wherein said base plate has an interior surface and a recess defined by said interior surface.

5. An adjustable wrench socket according to claim 4, wherein said collar plate has an interior surface with a shoulder formed thereon, said shoulder being formed to engage said recess formed in said base plate.

6. An adjustable wrench socket according to claim 1, wherein an exterior surface of said base plate has a wrench connector attached thereto.

7. An adjustable wrench socket according to claim 6, wherein said wrench connector is a polygonal bolt head.

8. An adjustable wrench socket according to claim 1, wherein said side walls extend above an exterior surface of said collar plate to form guide ridges.

9. An adjustable wrench socket according to claim 8, wherein said gripping members have fingers extending beyond said sidewalls and channels formed in said fingers and adapted to slidably engage said guide ridges.

10. An adjustable wrench socket according to claim 1, wherein a stop member is removably positioned on said adjustable socket in order to prevent relative rotation between said base plate and collar plate.

11. An adjustable wrench socket according to claim 10, wherein said stop member prevents relative rotation in one direction only.

12. An adjustable wrench socket according to claim 1, wherein each of said gripping members are rotatively connected to said base plate by way of a shaft connected to said gripping member and extending through an aperture in said base plate.

13. An adjustable wrench socket according to claim 1, wherein an outer perimeter of said base plate is substantially coextensive with an outer perimeter of said collar plate.

14. An adjustable wrench socket according to claim 1, wherein a second adjustable wrench socket is connected to said base plate.

15. An adjustable wrench socket according to claim 14, wherein the orientation of said gripping members is reversed as between said adjustable wrench sockets.

16. An adjustable wrench socket according to claim 14, wherein said adjustable wrench sockets have a aperture communicating therethrough and a wrench connector positioned inside said aperture.

17. A socket wrench, comprising:

a. a base, operatively connected to a rotatable drive shaft;

b. a collar, rotatably mounted to said base along an axis aligned with said drive shaft, said collar having an upper surface and a lower surface, said upper surface including:

i. a central recess having a bottom and a plurality of equal length side walls;

ii. a plurality of upwardly extending ridge members, said ridge members being equal in number to said side walls, and aligned with said side walls;

c. a plurality of movable gripping members, rotatably disposed within said base and in slidable engagement with said ridge members, said gripping members extending into said central recess to define a gripping region; wherein said gripping members are caused to adjust said gripping region upon rotation of said collar in a first rotational direction, and caused to expand said gripping region upon rotation of said collar in an opposite rotational direction.

18. An adjustable socket for a socket wrench, said adjustable socket comprising:

a. a base plate;

b. a collar plate rotatably attached to said base plate and having a central opening formed by a plurality of internal sidewalls;

c. a guide formed along each of said plurality of internal sidewalls; and d. a plurality of gripping members movably positioned in said central opening, i. each of said gripping members having a contacting surface which cumulatively define a gripping region, and ii. each of said gripping members being connected to said base plate and having:

(1) a first end engaging one of said internal sidewalls and moving slidably in said guide; and (2) a second end adapted to engage another one of said plurality of gripping members whereby relative rotation of said base plate and said collar plate causes said first ends to slide along said internal sidewalls and said second ends to slide along another gripping member thereby adjusting an area within said gripping region.

19. An adjustable wrench socket according to claim 18, wherein an exterior surface of said base plate has a wrench connector attached thereto.

20. An adjustable wrench socket according to claim 19, wherein said guides are extensions of said side walls extending above an exterior surface of said collar plate to form ridges.

21. An adjustable wrench socket according to claim 20, wherein said gripping members have fingers extending beyond said sidewalls with channels formed therein to slidably engage said ridges.

* * * * *